US011208938B2

(12) United States Patent
Hwang

(10) Patent No.: US 11,208,938 B2
(45) Date of Patent: Dec. 28, 2021

(54) EXHAUST TAIL TRIM FOR VEHICLE

(71) Applicants: Hyundai Motor Company, Seoul (KR); Kia Motors Corporation, Seoul (KR)

(72) Inventor: Dae Gil Hwang, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 460 days.

(21) Appl. No.: 16/291,910

(22) Filed: Mar. 4, 2019

(65) Prior Publication Data

US 2020/0123960 A1 Apr. 23, 2020

(30) Foreign Application Priority Data

Oct. 22, 2018 (KR) ..... 10-2018-0125705

(51) Int. Cl.

| | |
|---|---|
| ***F01N 13/08*** | (2010.01) |
| ***F01N 13/20*** | (2010.01) |
| ***F01N 13/18*** | (2010.01) |
| ***F01N 13/16*** | (2010.01) |
| ***F01N 13/14*** | (2010.01) |

(52) U.S. Cl.

CPC ..... *F01N 13/082* (2013.01); *F01N 13/16* (2013.01); *F01N 13/1838* (2013.01); *F01N 13/1844* (2013.01); *F01N 13/20* (2013.01); *F01N 13/141* (2013.01); *F01N 2260/00* (2013.01); *F01N 2260/20* (2013.01); *F01N 2450/18* (2013.01); *F01N 2530/18* (2013.01)

(58) Field of Classification Search

CPC .... F01N 13/082; F01N 13/1844; F01N 13/20; F01N 13/1838; F01N 13/16; F01N 13/141; F01N 2530/18; F01N 2450/18; F01N 2260/20; F01N 2260/00

See application file for complete search history.

(56) References Cited

U.S. PATENT DOCUMENTS 3,672,171 A * 6/1972 Eknayan ..... F01N 3/04 60/274
3,962,869 A * 6/1976 Wossner ..... F01N 3/24 60/298
3,986,665 A * 10/1976 Kofink ..... F01N 3/0205 237/12.3 A (Continued)

FOREIGN PATENT DOCUMENTS

JP 2007305865 A * 11/2007 ..... F28D 15/0275
JP 2010-059960 A 3/2010

(Continued)

*Primary Examiner* — Mark A Laurenzi
*Assistant Examiner* — Mickey H France
(74) *Attorney, Agent, or Firm* — Morgan, Lewis & Bockius LLP

(57) ABSTRACT

An exhaust tail trim for a vehicle capable of being manufactured in various colors and having advantages of improving aesthetic sense, improving sense of integrated design and improving merchantability of a vehicle may include a heat pipe assembly disposed at an outside of an exhaust pipe through which exhaust gas is discharged; and a trim cover disposed at an end portion of the exhaust pipe and located at an outside of the heat pipe assembly, where the trim cover is made of synthetic resin.

12 Claims, 4 Drawing Sheets

(56) References Cited

U.S. PATENT DOCUMENTS 4,811,720 A * 3/1989 Katumata ..... F02D 19/0647 123/527
5,189,266 A * 2/1993 Sasaki ..... F01N 1/165 181/227
5,477,676 A * 12/1995 Benson ..... E04C 2/34 60/274
7,063,134 B2 * 6/2006 Poole ..... F01N 1/006 165/163
7,832,204 B2 * 11/2010 Bidner ..... F28D 15/0275 60/320
7,895,835 B2 * 3/2011 Yaguchi ..... F02G 1/043 60/520
8,020,524 B2 * 9/2011 Miyagawa ..... F28F 1/126 123/41.33
8,839,613 B2 * 9/2014 Levin ..... B60H 1/20 60/320
9,101,971 B2 * 8/2015 Lee ..... B60K 13/04
9,896,986 B2 * 2/2018 Schydlo ..... F01N 5/02
2005/0204733 A1 * 9/2005 Sasaki ..... F28D 15/0266 60/320
2005/0284623 A1 * 12/2005 Poole ..... F01N 1/006 165/242
2006/0231235 A1 * 10/2006 Yamanaka ..... F28D 15/06 165/51
2008/0006394 A1 * 1/2008 Gupta ..... F01N 5/02 165/104.21
2008/0115923 A1 * 5/2008 Yamanaka ..... F28D 15/0233 165/276
2008/0141664 A1 * 6/2008 Bidner ..... F01N 5/02 60/320
2009/0000285 A1 * 1/2009 Miyagawa ..... F28D 15/06 60/320
2009/0000577 A1 * 1/2009 Miyagawa ..... F28D 15/06 123/41.2
2009/0020260 A1 * 1/2009 Miyagawa ..... F28D 15/0266 165/41
2009/0265934 A1 * 10/2009 Lee ..... F01N 13/1861 29/890.08
2010/0001535 A1 * 1/2010 Kimura ..... F01N 3/2006 290/1 A
2010/0011738 A1 * 1/2010 Zhang ..... F01N 3/043 60/39.5
2010/0011753 A1 * 1/2010 Bidner ..... F28D 15/02 60/320
2010/0154394 A1 * 6/2010 Partridge ..... F02M 31/005 60/298
2010/0206171 A1 * 8/2010 Peng ..... B01D 53/1481 96/235
2011/0131962 A1 * 6/2011 Toi ..... F01P 3/12 60/320
2012/0285766 A1 11/2012 Wirth et al.
2013/0037235 A1 * 2/2013 Sakabe ..... F28D 15/0266 165/41
2013/0199164 A1 * 8/2013 Levin ..... B60H 1/20 60/299
2013/0298539 A1 * 11/2013 Jang ..... E02F 9/0866 60/320
2014/0020638 A1 * 1/2014 Park ..... F01N 13/082 123/41.01
2014/0283506 A1 * 9/2014 Kuroki ..... F28D 15/0275 60/320
2014/0345833 A1 * 11/2014 Hwang ..... B60K 13/04 165/104.28
2015/0135689 A1 * 5/2015 Resch ..... H01L 35/325 60/320
2015/0218997 A1 * 8/2015 Kato ..... F28D 21/0003 165/103
2017/0138313 A1 * 5/2017 Fujimoto ..... F02M 25/0227
2017/0328257 A1 * 11/2017 Ishikawa ..... F01N 1/166
2018/0058635 A1 * 3/2018 Salter ..... F21K 2/005
2018/0299016 A1 * 10/2018 Asai ..... F16K 27/0227
2019/0032599 A1 * 1/2019 Murata ..... F02G 5/02
2019/0136748 A1 * 5/2019 Anschel ..... F02B 37/004
2020/0123960 A1 * 4/2020 Hwang ..... F01N 13/1844
2021/0140391 A1 * 5/2021 Huscher ..... F02B 39/085

FOREIGN PATENT DOCUMENTS

JP 2010-274810 A 12/2010
JP 2010-275999 A 12/2010
JP 2013-508615 A 3/2013
JP 2015-055177 A 3/2015
KR 10-0461076 B1 12/2004
KR 10-0962811 B1 6/2010
KR 10-2012-0099051 A 9/2012
KR 10-1209732 B1 12/2012
KR 10-2015-0080884 A 7/2015

* cited by examiner

【FIG. 1】 --RELATED ART--
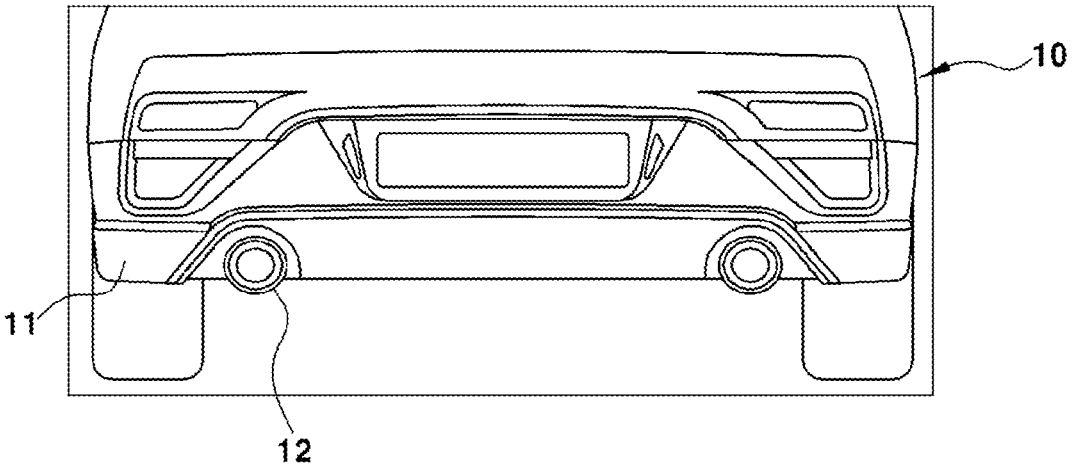
【FIG. 2】
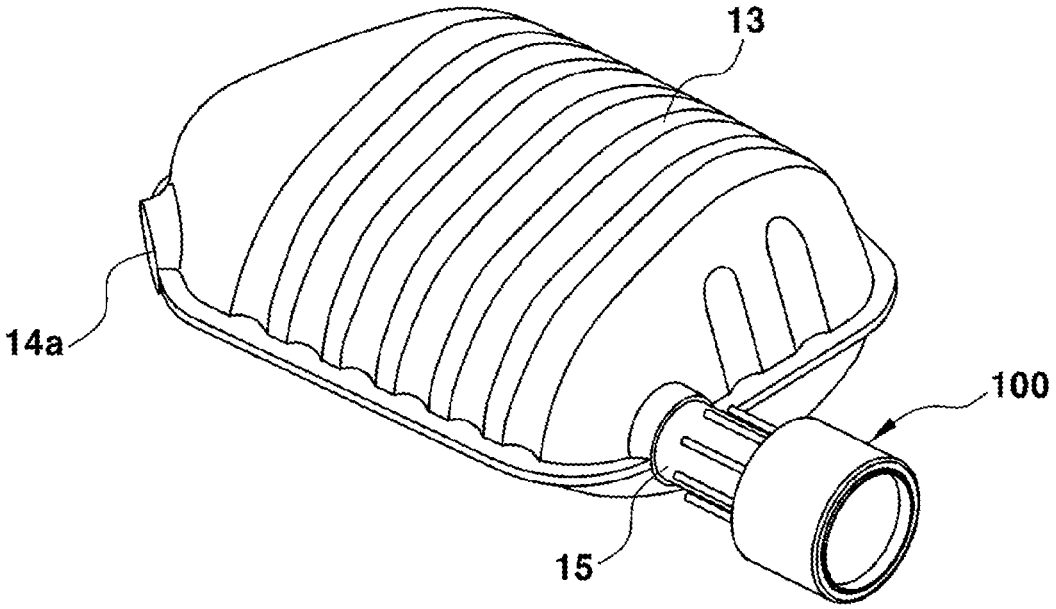

【FIG. 3】
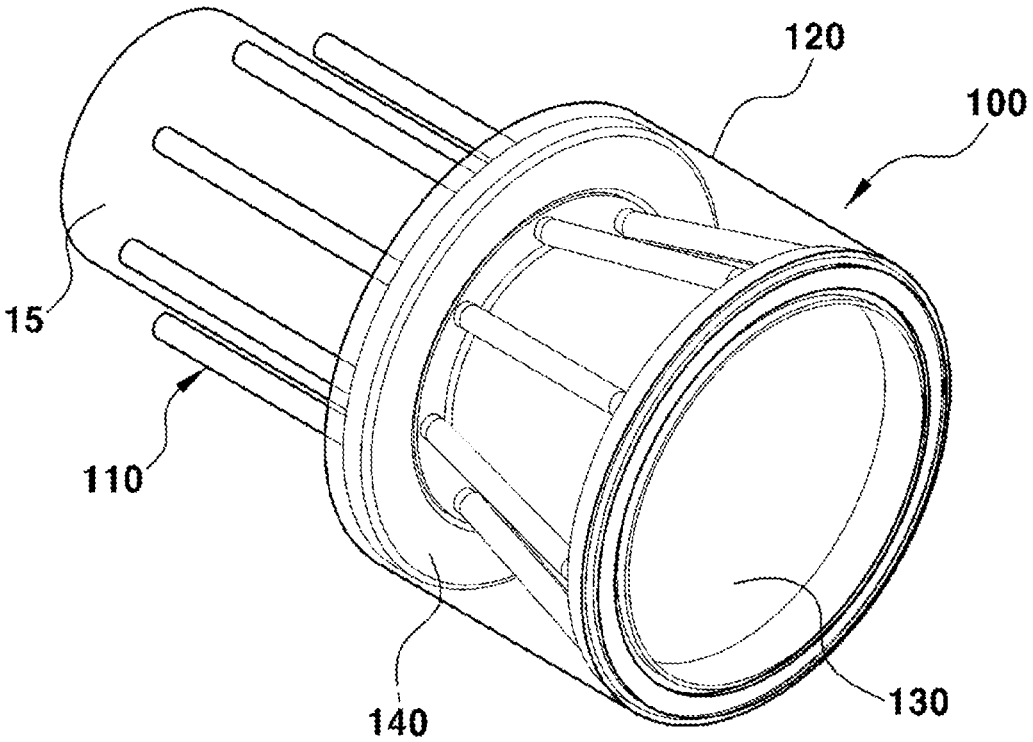
【FIG. 4】
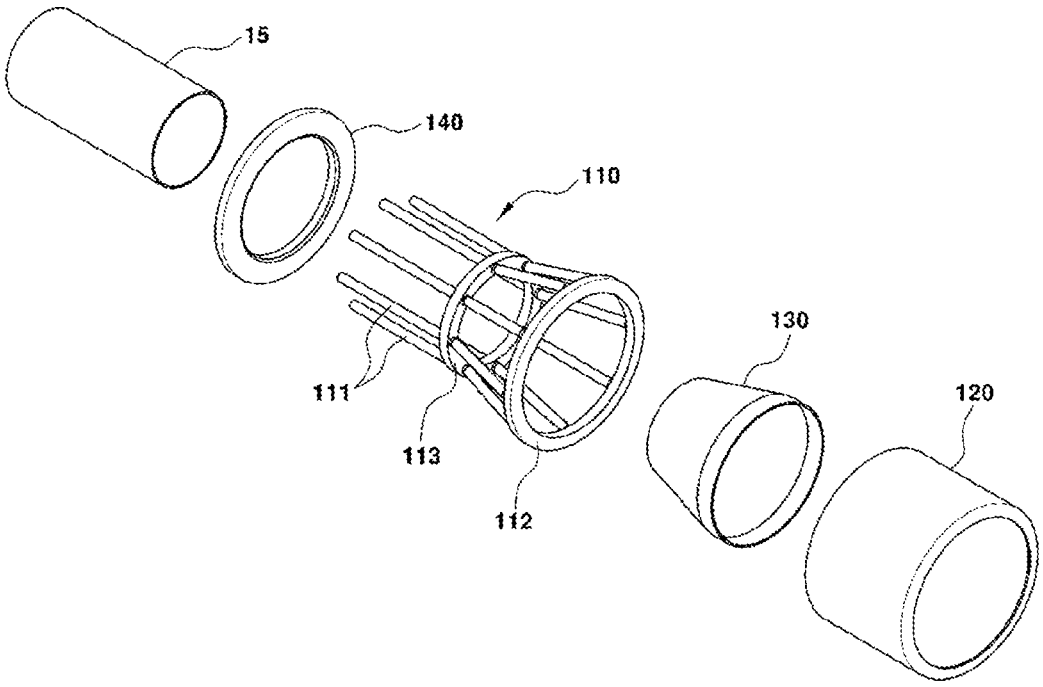

【FIG. 5】
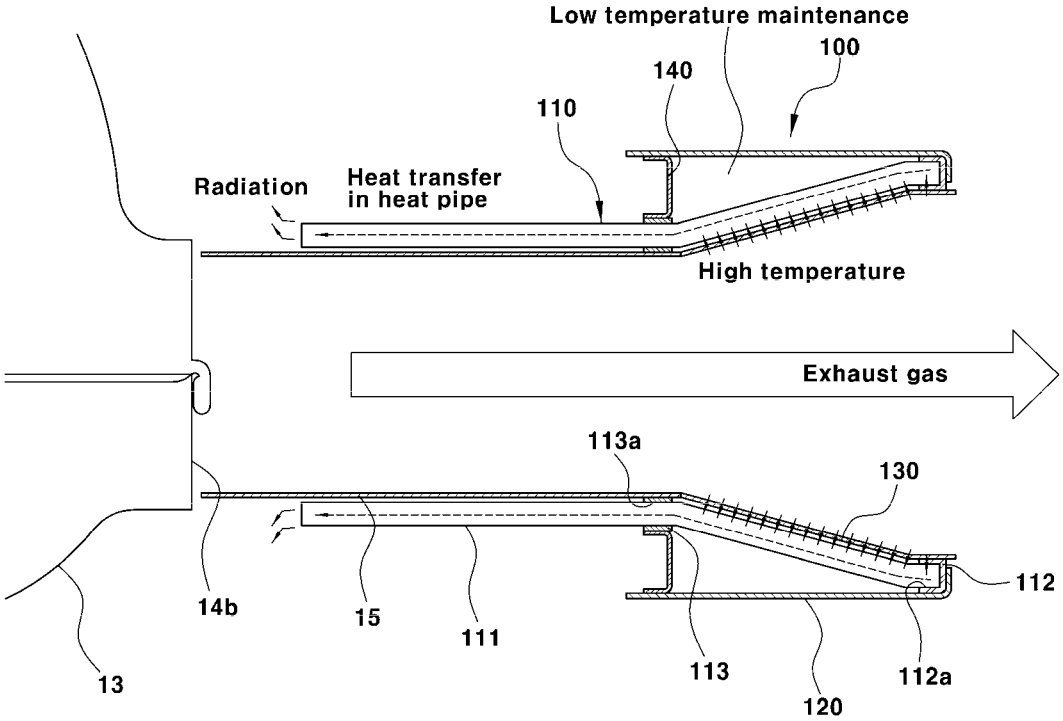
【FIG. 6】
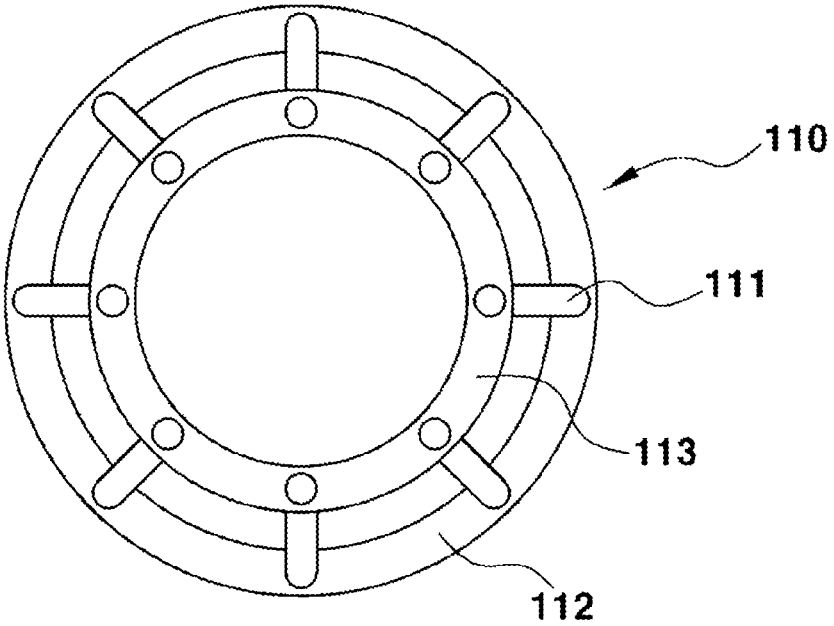

【FIG. 7】
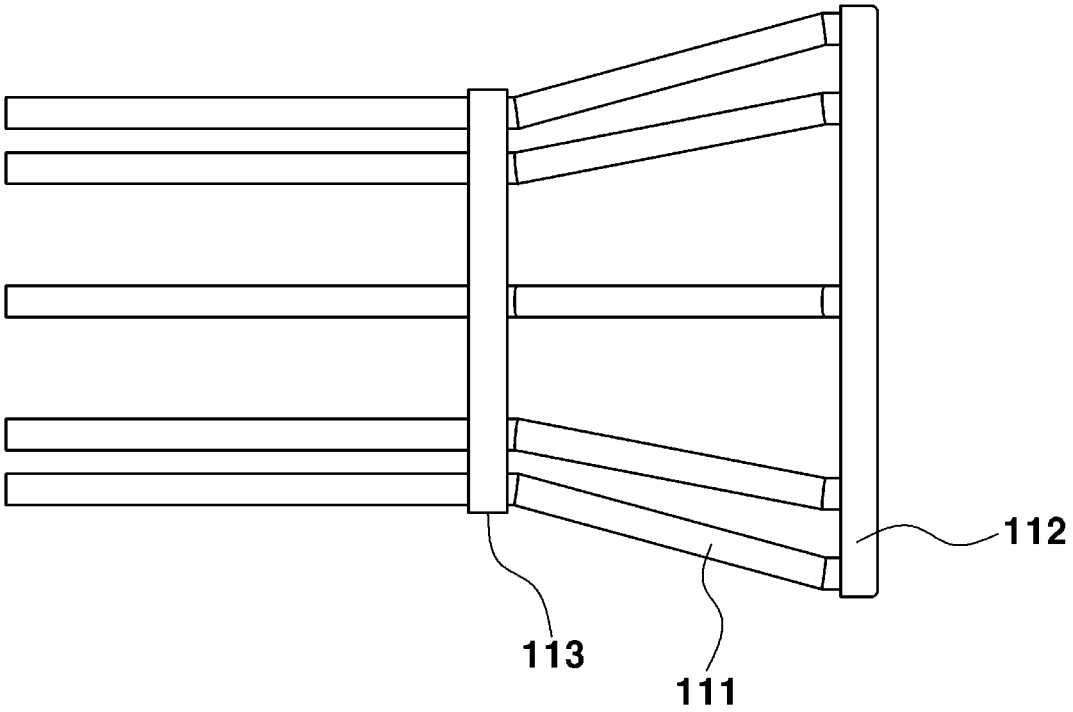
【FIG. 8】
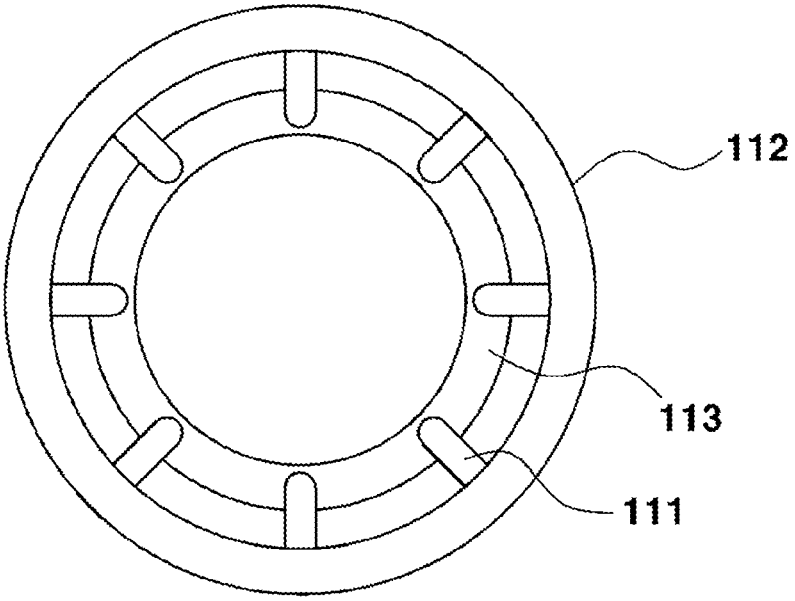

EXHAUST TAIL TRIM FOR VEHICLE

CROSS-REFERENCE TO RELATED APPLICATION

This application claims the benefit of priority to Korean Patent Application No. 10-2018-0125705 filed on Oct. 22, 2018, the entire contents of which are incorporated herein by reference.

TECHNICAL FIELD

The present disclosure relates to an exhaust tail trim for a vehicle, and more particularly, the present disclosure relates to an exhaust tail trim for a vehicle having advantages of being able to be produced in various colors to improve aesthetic sense, design unity sense and merchantable quality of a vehicle.

BACKGROUND

In general, an exhaust system of a vehicle includes an exhaust manifold where the exhaust gas discharged from each cylinder of the engine are mixed, an exhaust pipe connected with the exhaust manifold, and a muffler installed in the middle of the exhaust pipe.

The exhaust pipe is elongated toward a rear bumper of a vehicle, and the exhaust gas discharged and generated from the engine is discharged through the exhaust pipe from the rear of the vehicle to the outside.

The muffler is installed on the exhaust pipe. An exhaust tail trim is attached to the end portion of the exhaust pipe in the end of the muffler. An ordinary exhaust tail trim is provided in the form of a tubular structure or assembly.

The exhaust tail trim is formed of stainless steel to improve the appearance of the rear end of the vehicle and to have a diameter larger than the diameter of the exhaust pipe to delay the exhaust velocity of the exhaust gas discharged through the exhaust pipe, thereby preventing pedestrians from being injured by heat from the exhaust gas.

In recent years, the height of the vehicle body is reduced by reducing the gap between a rear bumper and the road surface of the vehicle as much as possible to ensure high-speed running stability of a vehicle. Thus, an integral rear bumper structure with the exhaust pipe and the tail trim inserted into the interior of the rear bumper has been applied.

On the other hand, as shown in FIG. 1, a tail trim 12 is one of the exterior parts that can be exposed to the outside of the vehicle 10 and that gives the vehicle a sense of luxury and aesthetics along with the rear bumper 11.

However, since the conventional tail trim 12 is usually made of a stainless steel material, it has drawbacks of high cost and weight.

Further, in the case of the conventional tail trim, there are limitations in producing various colors, and it is impossible to realize various colors other than the silver color in the characteristic of the stainless steel material.

In recent years, it is possible to further implement a black (dark) colors by coating, plating, or film formation. When this is applied, there are disadvantages in terms of quality and mass production, and there are problems such as discoloration, stain, spots, peeling due to high temperature exposure and material characteristics.

The above information disclosed in this Background section is only for enhancement of understanding of the background of the disclosure and therefore it may contain information that does not form the prior art that is already known in this country to a person of ordinary skill in the art.

SUMMARY

Accordingly, the present disclosure has been made to solve the above problems, and the object thereof is to provide an exhaust tail trim for a vehicle capable of producing various colors, thereby having advantages of improving aesthetic sense, improving the sense of unity of design, and improving vehicle commerciality.

Further, another object of the present disclosure is to provide an exhaust tail trim for a vehicle capable of lowering cost and weight compared to conventional stainless steel materials, fundamentally solving the corrosion problem while ensuring high temperature durability, and fundamentally solving quality problems such as coating exfoliation, peeling, discoloration, staining compared to coating, painting and applying film.

An exhaust tail trim according to an exemplary embodiment of the present disclosure in order to achieve the above objects may include a heat pipe assembly disposed at an outside of an exhaust pipe through which exhaust gas is discharged; and a trim cover disposed at an end portion of the exhaust pipe and located at an outside of the heat pipe assembly. The heat pipe assembly may receive heat of the exhaust gas passing through the exhaust pipe and emits the heat to the outside of the heat pipe assembly.

In a preferred embodiment, an expanding tube portion being connected with the end portion of the exhaust pipe and having a shape in which a diameter thereof increases gradually toward an outlet of the exhaust gas and a bracket disposed between the exhaust pipe and the trim cover to fix and support the trim cover with respect to the exhaust pipe are further included; and the trim cover may be installed to surround the expanding tube portion.

Further, in a preferred embodiment, the heat pipe assembly may include a plurality of heat pipes disposed around the exhaust pipe and the expanding tube portion; and a holder connecting and fixing the plurality of heat pipes.

Furthermore, in a preferred embodiment, each of the plurality of heat pipes may be disposed on an exterior of the exhaust pipe and the expanding tube portion in a longitudinal direction thereof and to absorb the heat from the expanding tube portion.

In addition, in a preferred embodiment, the plurality of heat pipes may be disposed at predetermined intervals along a circumference direction of the exhaust pipe and the expanding tube portion.

Additionally, in a preferred embodiment, the plurality of heat pipes may be disposed at constant intervals along the circumference direction of the exhaust pipe and the expanding tube portion.

Further, in a preferred embodiment, the plurality of heat pipes may be fixed to have a constant gap with an exterior circumference of the exhaust pipe and the exterior circumference of the expanding tube portion by the holder.

Furthermore, in a preferred embodiment, the holder may include a first holder assembled at one end portion of the heat pipe; and a second holder assembled at another portion of the heat pipe; and the first holder may have a ring shape member assembled at the exterior circumference of the expanding tube portion, and the second holder has a ring shape member assembled at the exterior circumference of the exhaust pipe.

In addition, in a preferred embodiment, the first holder may include at least one insertion groove disposed along a circumference direction, wherein each end portion of the plurality of heat pipes is inserted into the at least one insertion groove; and the second holder may include at least one insertion hole disposed along the circumference direction, wherein each of the plurality of heat pipes penetrates through and is coupled to the at least one insertion hole.

Additionally, in a preferred embodiment, the bracket may be formed of a ring shape and installed along the second holder.

Further, in a preferred embodiment, the trim cover may be coupled to and supported by the second holder.

Furthermore, in a preferred embodiment, the trim cover may be made of synthetic resin.

In accordance with the exhaust tail trim for the vehicle according to the present disclosure, the trim cover that are exposed to the outside can be made in various colors as it are made of synthetic resin. In this case, the desired color can be selected considering the vehicle design such as the shape and color of the rear bumper.

Eventually, the tail trim and the overall aesthetic sense and design integrity sense of the vehicle can be improved and the merchantability of the vehicle can be improved.

Further, in the tail trim including the trim cover of synthetic resin material, compared to the tail trim of existing stainless steel material, it is possible to reduce weight and cost, corrode problem can be solved fundamentally, and it can fundamentally solve quality problems such as coating exfoliation, peeling, discoloration, staining compared to coating, painting and applying film.

Other aspects and preferred embodiments of the disclosure are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the disclosure are discussed infra.

BRIEF DESCRIPTION OF THE DRAWINGS

The above and other features of the present disclosure will now be described in detail with reference to certain exemplary embodiments thereof illustrated in the accompanying drawings which are given herein below by way of illustration only, and thus are not limitative of the present disclosure, and wherein:

FIG. 1 is a drawing showing the rear end of a vehicle with a conventional exhaust tail trim installed;

FIG. 2 is a perspective view showing a muffler and an exhaust pipe to which a tail trim is applied according to an exemplary embodiment of the present disclosure;

FIG. 3 is an assembled perspective view of the tail trim according to an exemplary embodiment of the present disclosure;

FIG. 4 is an exploded perspective view to show the composition of the tail trim according to an exemplary embodiment of the present disclosure;

FIG. 5 is a cross-sectional view showing the tail trim according to an exemplary embodiment of the present disclosure;

FIGS. 6 to 8 are drawings illustrating the heat pipe assembly in each direction in the tail trim according to an exemplary embodiment of the present disclosure.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter, reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

In the whole description, it will be understood that when a component is referred to as being "comprising" any component, it does not exclude other components, but can further comprises the other components unless otherwise specified.

FIG. 2 is a perspective view showing a muffler and an exhaust pipe to which a tail trim is applied according to an exemplary embodiment of the present disclosure.

A muffler 13 may be installed in an exhaust pipe, the inlet 14*a* in which the exhaust gas is flowed from the muffler 13 may be connected to the upstream side exhaust pipe (not shown), and the outlet 14*b* in which the exhaust gas is exhausted from the muffler 13 may be connected with a downstream side exhaust pipe 15.

Further, as shown in FIG. 2, a tail trim 100 according to an exemplary embodiment of the present disclosure may be attached at the downstream side exhaust pipe 15.

In the above description, the exhaust pipe connected to the inlet 14*a* and the outlet 14*b* of muffler 13 is classified as the upstream side exhaust pipe and the downstream side exhaust pipe 15, respectively, based on the direction of flow of exhaust gas. In the following description, however, the upstream side exhaust pipe and the downstream side exhaust pipe 15 are referred to as an exhaust pipe.

FIG. 3 is an assembled perspective view of the tail trim according to an exemplary embodiment of the present disclosure.

FIG. 4 is an exploded perspective view to show the composition of the tail trim according to an exemplary embodiment of the present disclosure.

Further, FIG. 5 is a cross-sectional view showing the tail trim according to an exemplary embodiment of the present disclosure; and FIGS. 6 to 8 are drawings illustrating the heat pipe assembly in each direction in the tail trim according to an exemplary embodiment of the present disclosure.

As shown in drawings, the tail trim 100 according to an exemplary embodiment of the present disclosure may include a heat pipe assembly 110 installed on an outer surface of an exhaust pipe 15 through which the exhaust gas is exhausted and a trim cover 120 installed at an end portion of the exhaust pipe 15 so as to be located outside the heat pipe assembly 110.

Further, the tail trim 100 according to an exemplary embodiment of the present disclosure may further include an expanding tube portion 130 connected to an end portion of the exhaust pipe 15 and having a diameter gradually increasing toward a rear outlet through which the exhaust gas is discharged, and a bracket 140 installed between the exhaust pipe 15 and the trim cover 120 to fix and support the trim cover 120 at the exhaust pipe 15.

According to an exemplary embodiment of the present disclosure, as shown in FIG. 5, the exhaust pipe 15 at the front of the expanding tube portion 130 may have a straight tube shape with a constant diameter.

This is illustrative and it is to be understood that the present disclosure is not intended to be limited. The exhaust pipe 15 in front of the expanding tube portion 130 is not limited to having a constant diameter and straight tube shape in the exemplary embodiment of the present disclosure.

For example, the exhaust pipe 15 may have a curved shape, such as a bent shape, or a shape whose diameter changes while following the length direction.

The heat pipe assembly 110 may include a plurality of heat pipes 111 disposed to be spaced apart from each other at an outer side of the exhaust pipe 15 and the expanding tube portion 130, and holders 112 and 113 for connecting and fixing the plurality of heat pipes 111 to one another to be an assemble state.

According to an exemplary embodiment of the present disclosure, each of the heat pipes 111 may be disposed so as to be long in the longitudinal direction thereof at the outer periphery of the exhaust pipe 15 and the expanding tube portion 130 of the tail trim 100, and the heat pipes 111 may be disposed so as to be spaced apart from each other circumferentially around the outside of the exhaust pipe 15 and the expanding tube portion 130.

That is, a plurality of heat pipes 111 are disposed so as to surround the exhaust pipe 15 and the expanding tube portion 130, respectively, and a separate heat pipe is not installed in the exhaust pipe 15 and the expanding tube portion 130 but the heat pipes 111 are installed to wrap up the exhaust pipe 15 and the expanding tube portion 130.

Preferably, when the heat pipes 111 are disposed so as to be long back and forth along the outer periphery of the exhaust pipe 15 and the outer periphery of the expanding tube portion 130, the heat pipes 111 may be located at the outer periphery of the exhaust pipe 15 and the expanding tube portion 130 at regular intervals along the circumference direction.

Further, the heat pipes 111 are disposed to be spaced apart from the exterior circumference of the exhaust pipe 15 and the exterior circumference of the expanding tube portion 130 by a certain interval.

For this, as shown in FIGS. 5 to 8, all of the heat pipes 111 disposed so as to be long back and forth should have a shape corresponding to the shape of the exhaust pipe 15 having a constant diameter and the shape of the expanding tube portion 130 whose diameter gradually increases.

Thus, at the outer periphery of the exhaust pipe 15, the entire heat pipes 111, as shown in FIG. 5, are disposed side by side with the exhaust pipe 15 and the heat pipes are disposed to maintain a constant interval between each other.

On the other hand, at the outer periphery of the expanding tube portion 130, the entire heat pipes 111 maintain a constant gap with the outer surface the expanding tube portion 130 as in the exhaust pipe 15, but, since the diameter of the expanding tube portion 130 gradually increases toward the rear side, the heat pipes 111 are disposed so that the gap between the heat pipes 111 gradually increase toward the rear side also.

In the heat pipe assembly 110, the holders 112 and 113 serve to integrally combine the heat pipes 111 while maintaining the gap between the heat pipes 111, and the holders 112 and 113 may be members of a ring shape assembled to closely contact the exterior circumference of the exhaust pipe 15 and the exterior circumference of the expanding tube portion 130.

In the exemplary embodiment of the present disclosure, the holder may include a first holder 112 assembled to one end portion of the heat pipe 111 and a second holder 113 assembled to the middle of the heat pipe 111, and the first holder 112 may be assembled to the exterior circumference of the expanding tube portion 130 and the second holder 113 may be assembled to the exterior circumference of the exhaust pipe 15.

Also, as shown in FIG. 5, the first holder 112 is formed with an insertion groove 112*a* in which one end portion of each heat pipe 111 is inserted, and the second holder 113 is formed with an insertion hole 113*a* which each heat pipe 111 penetrates through and couples to.

According to an exemplary embodiment of the present disclosure, the insertion grooves 112*a* of the first holder 112 are disposed and formed at predetermined intervals along the first holder 112 so that the end portions of the heat pipes 111 disposed at predetermined intervals (for example, at regular intervals) along the circumferential direction can be inserted into the insertion groove 112*a*, respectively.

Further, the insertion holes 113*a* of the second holder 113 may also be disposed at predetermined intervals along the second holder 113 so that the heat pipes 111 disposed at predetermined intervals (for example, at regular intervals) along the circumferential direction can penetrate through the insertion holes 113*a*, respectively.

On the other hand, in the tail trim 100 according to an exemplary embodiment of the present disclosure, the heat pipes 111 are installed, as described above, to be positioned around the exhaust pipe 15 and the expanding tube portion 130, fixed at the exhaust pipe 15 and the expanding tube portion 130 through the first holder 112 and the second holder 113 at this time, and the trim cover 120 may be installed outside the heat pipe assembly 110 having such a configuration.

The trim cover 120 may have a tube shape, for example, a cylindrical tube shape as shown in drawings, and may be installed to surround the expanding tube portion 130 from the outside as a whole and installed so as to enclose a part of the rear end of the exhaust pipe 15 together.

In order to fix and mount the trim cover 120, the bracket 140 having a ring shape disposed along the circumferential direction is installed outside the heat pipe assembly 110, and the trim cover 120 is coupled to the bracket 140.

In an exemplary embodiment of the present disclosure, the bracket 140 may be installed along the exterior circumference of the second holder 113 of the heat pipe assembly 110.

According to one aspect of the present disclosure, the interior circumference of the bracket 140 and the exterior circumference of the second holder 113 may be joined together and the exterior circumference of the bracket 140 and the interior circumference of the trim cover 120 may be joined together.

Therefore, the trim cover 120 can be supported on the second holder 113 via the bracket 140, where the bracket 140 is interposed between the interior circumference of the trim cover 120 and the exterior circumference of the second holder 113 to be assembled together.

The other end of the trim cover 120 may be coupled to the first holder 112 of the heat pipe assembly 110 coupled to the expanding tube portion 130 with one end of the trim cover 120 being supported by the bracket 140.

That is, as shown in FIG. 5, the front end portion of the trim cover 120 can be coupled to the bracket 140 and the rear end portion of the trim cover 120 can be coupled to the first holder 112, where the inner circumference of the front end of the trim cover 120 is joined to the outer circumference of the bracket 140 and the inner circumference of the rear end of the trim cover 120 is joined to the outer circumference of the first holder 112.

Referring to FIG. 5, the heat pipe 111 is disposed back and forth along the length direction of the exhaust pipe 15 and the expanding tube portion 130, where the trim cover 120 is installed to surround a part of the rear end of the expanding tube portion 130 and the exhaust pipe 15.

In the tail trim according to the present disclosure, the trim cover 120 can be made of a synthetic resin excellent in heat resistance, especially, high heat resistant plastic material capable of withstanding the high temperature of the exhaust gas.

According to an exemplary embodiment of the present disclosure, the bracket 140 may be made of synthetic resin excellent in heat resistance or metal. The bracket 140 of metal material can be fastened to the second holder 113 by methods such as welding, and the like, and the bracket 140 of synthetic resin material may be fastened by using fastening members such as pins or bolts-nuts, screws, and the like, not shown in drawings.

Further, in the fastening between the trim cover 120 and the bracket 140 of the synthetic resin material and the fastening between the trim cover 120 and the first holder 112, a fastening member such as pins, bolts-nuts, screws or the like may be used, now shown in drawings.

In addition, the heat pipes 111 of the heat pipe assembly 110 may be installed to transfer heat from the rear to the front, and each heat pipe 111 is installed to draw heat in the expanding tube portion 130 of high temperature, and the aspirated heat, as shown in FIG. 5, is forwarded along the respective heat pipes 111 to the front, and then discharged to the outside through the end portion adjacent to the muffler 13 at each heat pipe 111.

That is, the heat pipe assembly 110 receives the heat of the exhaust gas passing through the exhaust pipe 15 through the tail trim 100, more clearly, the expanding tube portion 130 of the tail trim 100 to emit into the outside air.

As a result, the heat pipes 111 suck heat from the expanding tube portion 130 surrounding the trim cover 120 and pumps to the opposite end, and then exhaust to the outside, so that the expanding tube portion 130 and the trim cover 120, in which heat is sucked, can be maintained at the low temperature state compared with the prior art, and as a result, the trim cover made of synthetic resin can be applied.

Thus, in the case of an exhaust tail trim according to an exemplary embodiment of the present disclosure, the trim cover, which is exposed to the outside, is made of synthetic resin to be manufactured in various colors. In this case, the desired color can be selected considering the vehicle design such as the shape, color, and the like, of the rear bumper.

Eventually, the aesthetic sense and integrated design of the tail trim and the overall vehicle as well as merchantability of the vehicle can be improved. Further, in the tail trim including the trim cover of synthetic resin material, compared to the tail trim of existing stainless steel material, it is possible to reduce weight and cost, corrode problem can be solved fundamentally, and it can fundamentally solve quality problems such as coating exfoliation, peeling, discoloration, staining compared to coating, painting and applying film.

What is claimed is:

1. An exhaust tail trim for a vehicle, comprising:

a heat pipe assembly disposed at an outside of an exhaust pipe through which exhaust gas is discharged; and a trim cover disposed at an end portion of the exhaust pipe and located at an outside of the heat pipe assembly; and wherein the heat pipe assembly receives heat of the exhaust gas passing through the exhaust pipe and emits the heat to the outside of the heat pipe assembly.

2. The exhaust tail trim for the vehicle of claim 1, further comprising:

an expanding tube portion being connected with the end portion of the exhaust pipe and having a shape in which a diameter thereof increases gradually toward an outlet of the exhaust gas; and a bracket disposed between the exhaust pipe and the trim cover to fix and support the trim cover with respect to the exhaust pipe; and wherein the trim cover is installed to surround the expanding tube portion.

3. The exhaust tail trim for the vehicle of claim 2, wherein the heat pipe assembly comprises:

a plurality of heat pipes disposed around the exhaust pipe and the expanding tube portion; and a holder connecting and fixing the plurality of heat pipes.

4. The exhaust tail trim for the vehicle of claim 3, wherein each of the plurality of heat pipes is disposed on an exterior of the exhaust pipe and the expanding tube portion in a longitudinal direction thereof to absorb the heat from the expanding tube portion.

5. The exhaust tail trim for the vehicle of claim 4, wherein the plurality of heat pipes are disposed at predetermined intervals along a circumference direction of the exhaust pipe and the expanding tube portion.

6. The exhaust tail trim for the vehicle of claim 5, wherein the plurality of heat pipes are disposed at constant intervals along the circumference direction of the exhaust pipe and the expanding tube portion.

7. The exhaust tail trim for the vehicle of claim 3, wherein the plurality of heat pipes are fixed to have a constant gap with an exterior circumference of the exhaust pipe and the exterior circumference of the expanding tube portion by the holder.

8. The exhaust tail trim for the vehicle of claim 3, wherein the holder comprises:

a first holder assembled at one end portion of the heat pipe; and a second holder assembled at another portion of the heat pipe; and wherein the first holder has a ring shape member assembled at the exterior circumference of the expanding tube portion, and the second holder has a ring shape member assembled at the exterior circumference of the exhaust pipe.

9. The exhaust tail trim for the vehicle of claim 8, wherein:

the first holder includes at least one insertion groove disposed along a circumference direction, wherein each end portion of the plurality of heat pipes is inserted into the at least one insertion groove; and the second holder includes at least one insertion hole disposed along the circumference direction, wherein each of the plurality of heat pipes penetrates through and is coupled to the at least one insertion hole.

10. The exhaust tail trim for the vehicle of claim 8, wherein the bracket is formed of a ring shape and installed along the second holder.

11. The exhaust tail trim for the vehicle of claim 8, wherein the trim cover is coupled to and supported by the second holder.

12. The exhaust tail trim for the vehicle of claim 1, wherein the trim cover is made of synthetic resin.

* * * * *